United States Patent [19]

Kinoshita et al.

[11] Patent Number: 4,801,796

[45] Date of Patent: Jan. 31, 1989

[54] STREAK CAMERA UNIT WITH ELLIPTICAL DEFLECTION

[75] Inventors: Katsuyuki Kinoshita; Musubu Koishi; Yutaka Tsuchiya, all of Shizuoka, Japan

[73] Assignee: Hamamatsu Photonics Kabushiki Kaisha, Shizuoka, Japan

[21] Appl. No.: 942,348

[22] Filed: Dec. 16, 1986

[30] Foreign Application Priority Data

Dec. 16, 1985 [JP] Japan ..... 60-282690

[51] Int. Cl.[4] ..... H01J 31/50

[52] U.S. Cl. ..... 250/213 VT; 313/529

[58] Field of Search ..... 250/213 VT; 358/211, 358/217; 313/530, 529, 524, 525; 356/317, 318

[56] References Cited

U.S. PATENT DOCUMENTS

| | | | |
|---|---|---|---|
| 4,352,127 | 9/1982 | Tsuchiya | 250/213 VT |
| 4,431,914 | 2/1984 | Mourou et al. | 250/213 VT |
| 4,611,920 | 8/1986 | Tsuchiya | 250/213 VT |
| 4,645,918 | 2/1987 | Tsuchiya et al. | 250/213 VT |
| 4,661,694 | 4/1987 | Corcoran | 250/213 VT |
| 4,694,154 | 8/1967 | Tsuchiya et al. | 250/213 VT |
| 4,704,634 | 11/1987 | Kato et al. | 358/218 |

*Primary Examiner*—Edward P. Westin

*Attorney, Agent, or Firm*—Finnegan, Henderson, Farabow, Garrett & Dunner

[57] ABSTRACT

A streak camera having two pairs of orthogonal deflecting electrodes for producing elliptical waveform patterns. The sweep frequency is synchronized with a repetitive light source, and the eccentricity and position of the elliptical waveform can be adjusted such that part of the sweep excites the phosphor output screen and a return portion of the sweep may occur off the phosphor screen.

9 Claims, 7 Drawing Sheets

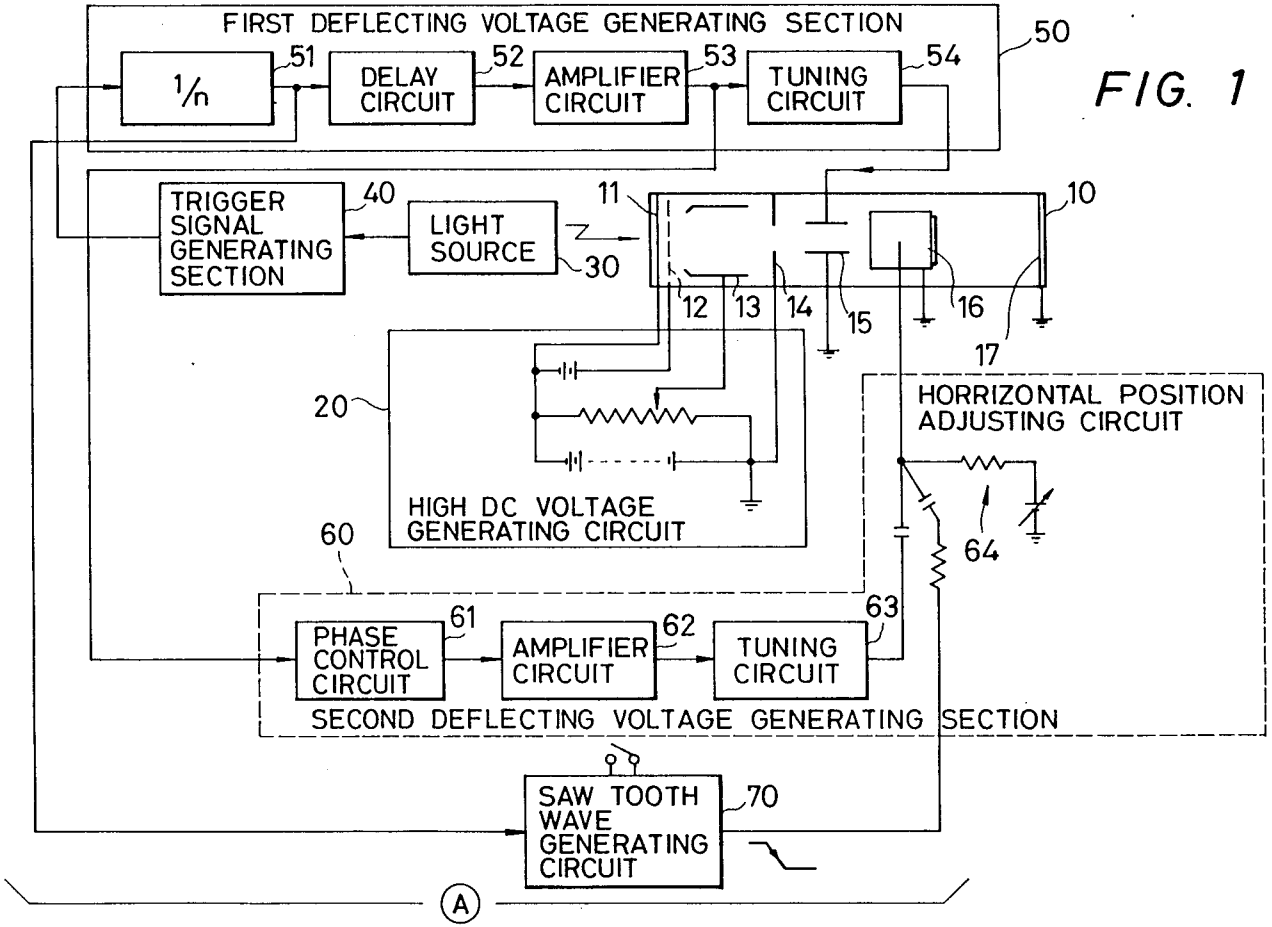
FIG. 1
FIRST DEFLECTING VOLTAGE GENERATING SECTION
50
1/n
51
DELAY CIRCUIT
52
AMPLIFIER CIRCUIT
53
TUNING CIRCUIT
54
TRIGGER SIGNAL GENERATING SECTION
40
LIGHT SOURCE
30
10
11
12
13
14
15
16
17
HIGH DC VOLTAGE GENERATING CIRCUIT
20
HORRIZONTAL POSITION ADJUSTING CIRCUIT
64
SECOND DEFLECTING VOLTAGE GENERATING SECTION
60
PHASE CONTROL CIRCUIT
61
AMPLIFIER CIRCUIT
62
TUNING CIRCUIT
63
SAW TOOTH WAVE GENERATING CIRCUIT
70
A

STREAK CAMERA UNIT WITH ELLIPTICAL DEFLECTION

BACKGROUND OF THE INVENTION

I. Field of the Invention

This invention relates to a streak camera unit with a streak tube which, for instance, is suitable for measuring a weak light beam which changes repeatedly with the same period and in the same pattern.

II. Background Information

A streak camera has been known as a device for measuring the temporal variation in intensity of a light emission which changes at high speed.

The streak camera includes an electron tube which is called a streak tube. The streak tube has a photocathode at one end, a phosphor screen (layer) at the other end and a pair of deflection electrodes are disposed therebetween.

When a light beam is applied to the photocathode of the streak tube, the photocathode emits photoelectrons as a function of the incident light beam. Thus the photoelectron beam changes in proportion to the intensity of the incident light beam.

When the photoelectron beam is passed through the electric field formed by the deflection electrodes while advancing towards the phosphor screen, it is deflected in one direction, resulting in the sweep on the phosphor screen. As a result the change in intensity of the incident light beam appears as the change in luminance of the phosphor screen in the direction of sweep (i.e., the direction of the time axis). This is a so-called "streak image." The streak image is photographed with a camera or detected with a TV (television) camera, so that the distribution of brightness or luminance of the streak image in the direction of sweep can be quantized for measurement of the change in intensity of the light beam.

The above-described streak tube is utilized in a so-called "synchroscan streak camera." The synchroscan streak camera is used to measure a weak light beam which is periodically produced. An example of the weak light beam of this type is fluorescence provided through high repetition laser pulse excitation. When a light beam under test is low in intensity, its streak image is also weak, and therefore it is difficult to accurately obtain its intensity distribution.

When the light beam to be measured is a pulsed light beam which occures with the same waveform and with the same period, the sine wave voltage whose period is coincident with that of the pulsed light beam and whose phase is in constant relation with that of the pulsed light beam is applied to the deflection electrodes of the streak tube. In this case, the streak images, having the same intensity distribution in the direction of sweep(i.e., the direction of time axis), can be superimposed at the position on the output phosphor screen. If the streak images are integrated n times, the streak image brightness(or optical energy) on the output screen is substantially increased by a factor of n, and therefore even a considerably weak light emission can be observed with a satisfactory signal to noise (SIN) ratio.

The high repetition laser employed usually is a mode locked dye laser having a repetition frequency of about 100 MHz. In this case, for instance in a one-second measurement, the integration can be made 100,000,000 times. The synchroscan streak camera is based on the above-described principle.

FIG. 8 is a block diagram of a synchroscan streak camera with its streak tube sectioned along the plane which includes the optical axis.

As shown in FIG. 8, a cylindrical housing 81 has a photocathode 82 formed on the inner surface of its other end which is transparent. A voltage which is lower than the ground potential is applied to the photocathode 82 from a power source $E_2$.

A mesh electrode 83 is disposed adjacent to the photocathode 82. In order to accelerate photo-electrons emitted from the photocathode 82, a voltage higher than that of the photocathode 82 is applied to the mesh electrode 83 from a power source $E_1$. A focus electrode 84 is arranged between the mesh electrode 83 and an anode plate 85 having an opening at the center. The anode plate 85 is grounded. Some part of the voltage of source $E_2$is applied to the focus electrode 84 so that the focus electrode 84 serves as an electron lens which focuses the photoelectrons emitted from the photocathode 82 on the phosphor screen 87.

A pair of deflection electrodes 86a and 86b made up of a pair of flat plates are disposed adjacent to the anode plate 85. A periodically varying voltage is applied across the deflection electrodes by a deflecting voltage generating means 88.

FIGS. 9A, 9B and 9C show a graphical representation to assist in explaining the operation of the synchroscan streak camera which is described above. In an ordinary synchroscan streak camera, the deflecting voltage generating means 88 produces a sine wave voltage as indicated in FIG. 9B. The parts $p_1$–$q_1$, $p_2$–$q_2$ . . . and $p_n$–$q_n$ of the sine wave voltage which change from positive to negative are used to deflect the electron beam from the upper edge to the lower edge of the phosphor screen 87.

The deflecting voltage is selected so that its frequency is the same as the repetitive frequency of a light beam to be measured, and its phase is in synchronism with the period of the beam.

In order to observe the light emission phenomenon shown in FIG. 9A, a sine wave voltage as shown in FIG. 9B is applied across the deflection electrodes 86a and 86b. This sine wave voltage which has a repetitive period can be generated synchronously in phase with a laser beam for exciting an object to be observed for instance, FIG. 9C shows the luminance distributions in the direction of the time axis on the phosphor screen 87 which are produced when the screen 87 is swept with the electron beam.

Assuming the optical intensity of the object under observation is low, the changes in the luminance distribution on the phosphor screen 87 which is provided at the first sweep with the part $p_1$–$q_1$ will be quite small as shown on screen (1) of FIG. 9C and often will not be detectable with the naked eye.

As the above-described operation is repeated, the luminance distribution becomes clear as is apparent from screens (2) and (3) of FIG. 9C. Theoretically, when the sweep is repeated n times, the luminance is approximately n times as great as that provided on the first sweep.

If the light beam under measurement is emitted for the sweep return periods $s_1$–$t_1$, $s_2$–$t_2$, . . . and $s_n$–$t_n$ of the sine wave sweep voltage synchronous with the period T, shown in FIG. 9B, the streak image formed by the parts $s_1$–$t_1$, $s_2$–$t_2$, . . . and $s_n$–$t_n$ will lie on that formed by the parts $p_1$–$q_1$, $p_2$–$q_2$, . . . $p_n$–$q_n$. However, these streak images are reversed in the time axis direction on the phosphor screen. Therefore, in this case, the images do not add and the measurement cannot be accomplished.

The above-described difficulty can be eliminated by employing a circularscan system such as is shown in FIG. 10. In FIG. 10, parts corresponding functionally to those which have been already described with reference to FIG. 8 are designated by corresponding reference numerals or characters.

The streak tube has, in addition to the above-described streak deflection electrodes 86*a* and 86*b*, another pair of deflection electrodes 89*a* and 89*b* which deflect the electron beam in a direction perpendicular to the direction of deflection of the deflecting electrodes 86*a* and 86*b*.

The conventional circularscan system is essential to measure the change with time of a single phenomenon. In general, a light beam incident to the photocathode 82 is focused like a spot, and the photoelectron beam emitted from the spot is deflected to sweep the phosphor screen by the deflecting fields which are formed by applying sine wave voltages which differ in phase by 90° from each other to the two pairs of deflection electrodes.

FIG. 11 is a diagram showing the output of the streak tube as viewed on the phosphor screen 87. As shown in FIG. 11, the sweep images appear circular; that is, the circular scan system is free from the above-described difficulty. Accordingly, the same repetitive light emissions can be observed as repetitive sweeps on each complete circular scan.

When a pulsed light beam's luminance or brightness is measured according to the synchronous scan system which has been described with reference to FIGS. 8 and 9, a number of problems take place because the streak images cannot be added to improve the S/N ratio.

In the case of a specimen generating a fluorescence whose period is longer than half of the period of the sweep voltage employed, the skirt of the fluorescence spreads to the return sweep period, and the streak images formed by the sweeps in the opposite time direction lie on each other. Therefore, the accurate fluorescent period cannot be measured.

Furthermore, if, in measurement of a semiconductor laser beam generated with a period which is just a fraction of one period of the sweep, the laser beam will be generated also in the return sweep period, the streak images will lie on each other on the output surface of the phosphor screen 87. Thus, in this case also, the measurement cannot be made.

As was described above, these problems can be solved by the circularscan system. In order to obtain quantitative data from the streak image, it is necessary to detect the output image with a TV (television) camera. However, processing the video signals of the TV camera can create serious problems.

FIG. 12 shows a streak image obtained using a linear sweep. FIG. 13 is a graphical representation indicating the intensity distribution of the streak image of FIG. 12 on the time axis. In the ordinary linear sweep, the TV camera operates in such a manner that the linear time axis is parallel with or perpendicular to the direction of scan of the image pickup tube. On the other hand, in the circular sweep, the operation is considerably more intricate.

If, as in a time resolved spectrophotometry, a linear sweep is performed with various wavelength rays arranged perpendicular to the direction of sweep, then streak images according to each wavelength as shown in FIG. 14 can be obtained. Therefore the data can be readily obtained by detecting and showing the images with a TV camera. On the other hand, using a circular sweep for various wavelengths, streak images are formed as shown in FIG. 15, and the output image is more difficult to analyze.

SUMMARY OF THE INVENTION

Accordingly, an object of this invention is to provide a streak camera unit in which the above-described difficulty that the streak images lie on each other has been eliminated and which can provide output images which can be readily analyzed.

The foregoing object of the invention has been achieved by the provision of a streak camera unit which, according to the invention, comprises a streak tube including a photocathode, first deflection electrodes for providing a first deflecting field along the time axis and second deflection electrodes for providing a second deflecting electric field in a direction substantially perpendicular to the first deflecting electric field, the first and second deflection electrodes following a focusing electron lens system of an image tube; a DC high voltage generating section for supplying operating voltages to the streak tube; a trigger signal generating section for obtaining a trigger signal from a light beam under measurement which is repetitively emitted; and deflecting voltage generating means for applying in synchronization with the trigger signal to the first deflection electrodes and the second deflection electrodes sine wave deflecting voltages whose frequencies are 1/n of the frequency of the trigger signal (where n is an integer) in order to achieve an elliptic sweep in such a manner that, with the composite field of the electric fields of the first and second deflection electrodes, the major axis thereof is extended in the direction of the time axis and the going and returning sweeps separate from each other are generated on the phosphor screen of the streak tube.

In the streak camera unit of the invention, a spectroscope is used for dispersing, in a direction perpendicular to the electric field of the first deflection electrodes, a light beam under measurement from a light source so that it is applied to the photocathode of the streak tube so that streak images are obtained in correspondence to the waveform components of the light beam. The spectroscope is located between the streak tube and the light source.

BRIEF DESCRIPTION OF THE DRAWINGS

FIG. 1 is a schematic block diagram showing a first example of a streak camera unit according to this invention.

DETAILED DESCRIPTION OF THE PREFERRED EMBODIMENTS

Figure 2:
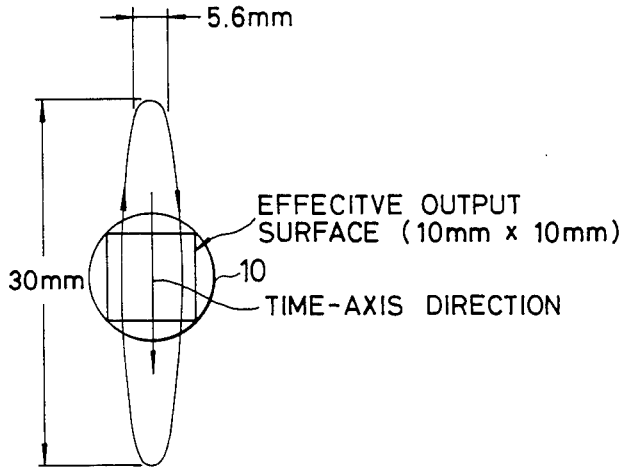
FIG. 2 is an explanatory diagram showing a first example of the output image of the streak camera unit.

This invention will be described with reference to the accompanying drawings in more detail. FIG. 1 is a block diagram showing a first example of a streak camera unit according to the invention.

As shown in FIG. 1, the streak camera unit has a streak tube 10 which is a vacuum tube. A photocathode 11, a mesh electrode 12, a focus electrode 13, an anode plate 14 with an opening at the center, a pair of first deflection electrodes 15 (deflecting an electron beam in the time axis direction), a pair of second deflection electrodes 16, and a phosphor screen 17 are provided in the streak tube 10. The sweep direction of the second deflection electrodes 16 is orthogonal with that of the first deflection electrodes 15.

Operating voltages are applied to the streak tube 10 by a DC high voltage generating section 20. Typically, −5 KV (with respect to the reference potential or ground potential) is applied to the photocathode 11, −4 KV to the mesh electrode 12, −4.4 KV to the focus electrode 13, and O V (ground potential) to the anode electrode 14. The phosphor screen 17, one of the pair of first deflection electrodes 15, and one of the pair of second deflection electrodes 16 are connected to the reference potential point.

For purposes of understanding the operation and structure of the streak camera of the invention, it will be assumed that a light source 30 for emitting a light beam to be measured generates a light beam at a repetitive rate which is an integer multiple of 80 MHz. A part of the light beam output by the light source 30 is applied to the photocathode of the streak tube 10, and another part to a trigger signal generating section 40 comprising a PIN diode which provides the trigger signal at its output. The trigger signal thus provided is applied to a first deflecting voltage generating section 50.

The first deflecting voltage generating section 50 includes a count-down circuit 51. In the count-down circuit 51, the aforementioned trigger signal is subjected to 1/n frequency division (where n is an integer) to provide a 80 MHz signal. This signal is applied to delay circuit 52. The signal, after being delayed by the delay circuit 52, is amplified by amplifier circuit 53 which is suitable for amplification of high frequency signals. The output signal of the amplifier circuit 53 is then applied to tuning unit 54.

Thus, the first deflecting voltage generating section 50 generates a sine wave signal which is synchronous with the trigger signal but has a period which is an integer fraction of that of the trigger signal, wherein n is an integer. The sine wave signal is applied, as a deflecting voltage, across the first deflection electrodes 15 in the streak tube 10. Adjustment of the delay time of the delay circuit 52 can select the relation in phase between the light beam under measurement and the deflecting voltage of the first deflection electrodes.

The streak camera unit further comprises a second deflecting voltage generting section 60 which includes a phase control circuit 61, an amplifier circuit 62, a tuning circuit 63, and a horizontal position adjusting circuit 64. In the phase control circuit 61, the phase difference between the deflecting voltages of the first and second deflection electrodes is made to be $90°+\alpha$ so that the photoelectron beam describes an ellipse in accordance with the electric fields formed by the first and second deflection electrodes.

If the time required for photoelectrons to transmit between the first and second deflection electrodes can be disregarded, then $\alpha$ can be zero (0). In the abovedescribed streak tube, the transit time of photoelectron between the two deflection electrodes is 300 ps. Therefore, with the frequency of 80 MHz, $\alpha$ is about 8.6° as is apparent from the following calculation:

$$(2\pi\times 80\times 10^{6}\times 300\times 10^{-12}\times 360/2\pi)=8.6°$$

The horizontal position adjusting circuit 64 operates to superpose a DC voltage on the sine wave output of the second deflecting voltage generating section 60, thereby to adjust the position of the streak image in a horizontal direction. With reference to the case where the output of the horizontal position adjusting circuit 64 is 0 v, the output image will be described. A voltage of 600 $V_{p\text{-}p}$ is applied across the first deflection electrodes 15, while a voltage of 200 $V_{p\text{-}p}$ is applied across the second deflection electrodes 16, wherein $V_{p\text{-}p}$ represents a total amplitude of the sine wave voltage. In the abovedescribed streak tube 10, the deflection sensitivity of the first deflection electrodes 15 is 50 mm/KV, and that of the second deflection electrodes 16 is 28 mm/KV.

In the case where the output phosphor screen 17 of the streak tube 10 is 10 mm×10 mm, the upper and lower end parts of the locus of the electron beam deflected by the deflection electrodes appear on the phosphor screen 17 as shown in FIG. 2. That is, only the remaining two parts of the ellipse which are substantially linear and substantially parallel to the time axis appear on the phosphor screen. In this case, the lengths of major and minor axis are 30 mm and 5.6 mm respectively because the deflection sensitivities of first and second deflection electrodes are 5 mm per 100 v and 2.8 mm per 100 V, respectively, and the ratio of the major axis of the ellipse to the minor axis is about 5.4. The streak images in the time axis direction may be regarded as linear, and once detected by the TV camera, the streak images can be readily processed.

Figure 3:
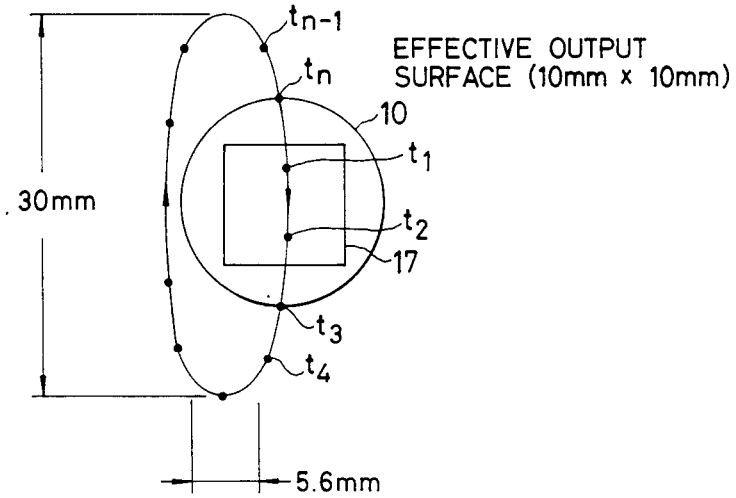
FIG. 3 is an explanatory diagram showing a second example of the output image of the streak camera unit.

FIG. 3 shows a second example of the streak camera unit according to the invention. In the case of FIG. 2, the return locus of the time axis sweep appears on the phosphor screen 17. In general, the return locus is not used for measurement, and therefore it may be moved outside the phosphor screen 17 as shown FIG. 3.

If the optical image formed by the return sweep is high in intensity, it may make the phosphor screen bright, thus increasing the brightness of the background. In order to eliminate this difficulty, in the second example of the streak camera unit of the invention, the horizontal position adjusting circuit of the second deflection voltage generating section 60 superposes a DC voltage on the sine wave voltage supplied across the second deflection electrodes 16 to adjust the position of the streak image in the horizontal direction, thereby to prevent the appearance of the return locus on the phosphor screen 17.

The output image shown in FIG. 3 is obtained according to the method in which a sine wave voltage of 600 $V_{p-p}$ is applied across the first deflection electrodes 15, and a voltage, obtained by superimposing a 100 V DC voltage on a sine wave voltage of 200 $V_{p-p}$, is applied across the second deflection electrodes 16. In this case, the streak image of the light beam incident to the center of the photocathode 11 in the streak tube 10 appears as passing through the center of the phosphor screen 17, while the streak image formed by the return sweep is outside the effective output surface of the screen; that is, it does not appear in the phosphor screen 17.

Figure 4:
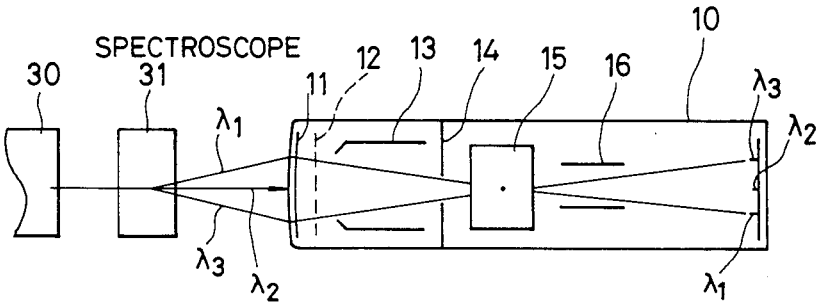
FIG. 4 is a schematic diagram showing a second example of the streak camera unit according to the invention.

FIG. 4 shows another example of the streak camera unit according to the invention; more specifically, a light input section and a streak tube (sectioned along a plane which is perpendicular to the time axis and includes the tube axis) in the streak camera unit. The light beam emitted from light source 30 is dispersed by a spectroscope 31 according to wavelength and applied to the photocathode 11 of the streak tube 10 in a direction perpendicular to the time axis direction.

Figure 5:
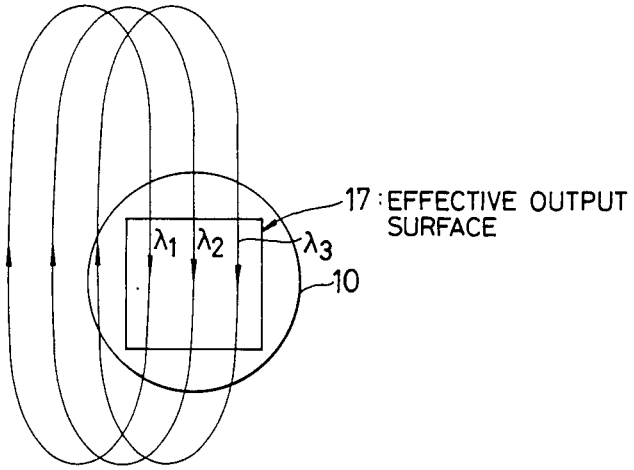
FIG. 5 is an explanatory diagram showing a third example of the output image of the streak camera unit.
Figure 15:
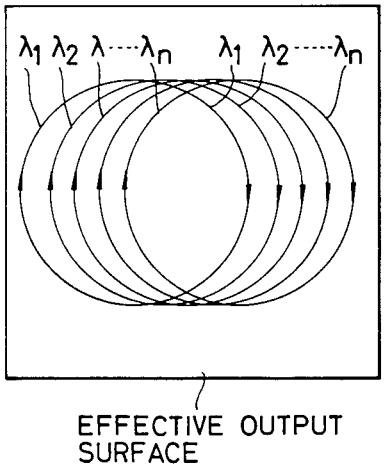
FIG. 15 is an explanatory diagram showing output images provided when spectrometry is carried out with the circularscan type streak camera.

When the streak tube 10 is operated under the same operating conditions as that in the case of FIG. 3, the resultant output image is as shown in FIG. 5; that is, on the effective output surface of the phosphor screen 17, the streak images of various wavelengths (1 through 3) are arranged substantially in parallel with the time axis. Accordingly, the difficulty described with reference to FIG. 15 is eliminated, and the streak images can be readily detected with an ordinary TV camera and processed.

If the delay time is controlled by adjusting the delay circuit 52 of the first deflecting voltage generating section in FIG. 1, then the information provided by the elliptic scanning line in FIG. 3 can be observed on the effective output surface of the screen 17.

In FIG. 3, the streak images at the time instants $t_1$ and $t_2$ are observed; however, if the delay time is shortened, then those at the time instants $t_3$, $t_4$ . . . and $t_n$ can also be observed. It may be considered that the elliptic scanning line is moved along the ellipse. Thus, the streak image corresponding to any desired part of one period of the sweeping sine wave voltage can be observed.

The above-described measuring method is effective especially in the following cases:

(1) In the case where the light beam to be measured is a repetitive pulse whose frequency is n times the sweep frequency, the streak images of the pulses are at the positions $t_1$, $t_2$, . . . and $t_n$ in FIG. 3, respectively. If, in this case, the above-described method is employed, then the pulses can be measured successively.

(2) If in the measurement of a relatively long fluorescent period which starts at $t_1$ and ends at $t_n$ in FIG. 3 for instance, the delay time is controlled, then the streak images can be measured in the order of $t_1$–$t_2$, $t_2$–$t_n$ . . . $t_{m-1}$ and $t_{m\ (tm>tn)}$; that is, the fluorescent period $t_1$–$t_m$ can be measured.

Figure 6:
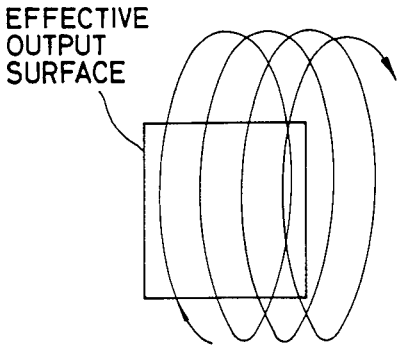
FIG. 6 is an explanatory diagram showing a fourth example of the output image of the streak camera unit.
Figure 7:
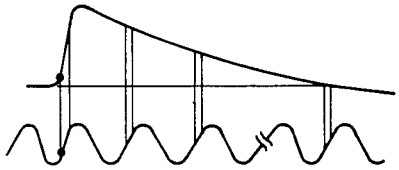
FIG. 7 is a graphical representation indicating the relation between the waveform of a light beam under observation and a deflecting voltage in the direction of time axis with reference to the fourth example of the output image shown in FIG. 6.
Figure 8:
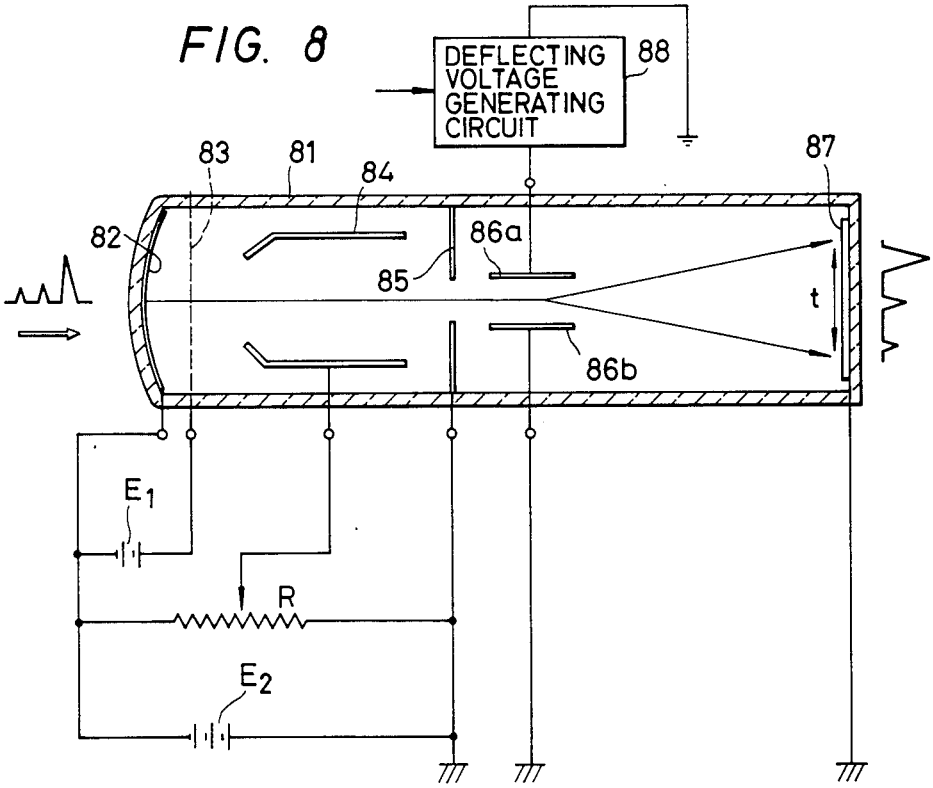
FIG. 8 is a schematic diagram showing one example of the arrangement of a conventional linear sweep type streak camera unit.
Figure 9:
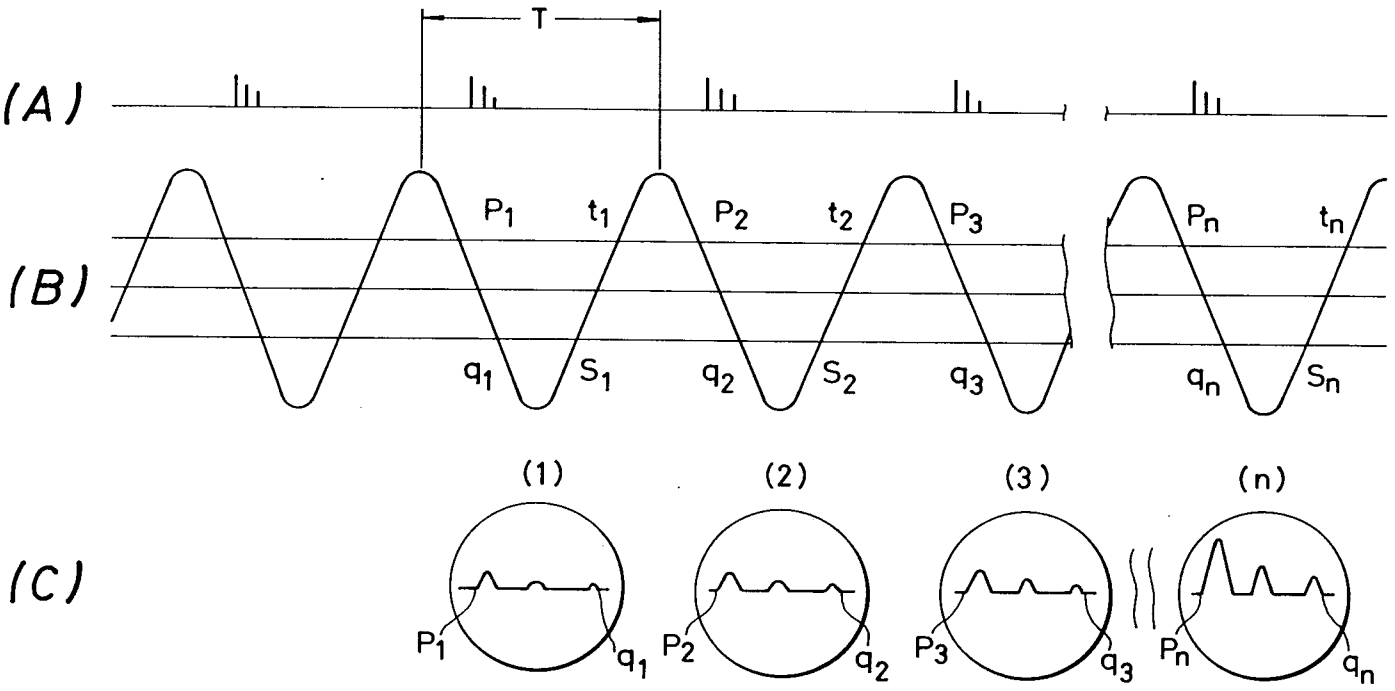
FIGS. 9A, 9B, and 9C are waveform diagrams for the description of the principle of a synchroscan streak system.
Figure 10:
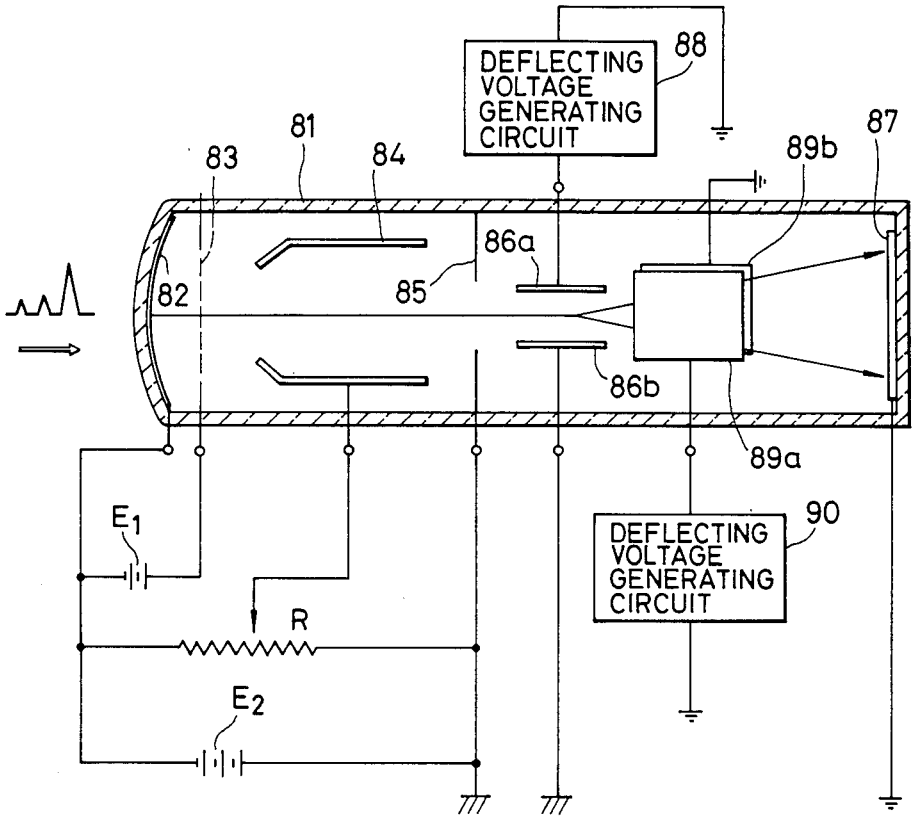
FIG. 10 is a schematic diagram showing one example of the arrangement of a conventional circular scan type streak camera.
Figure 11:
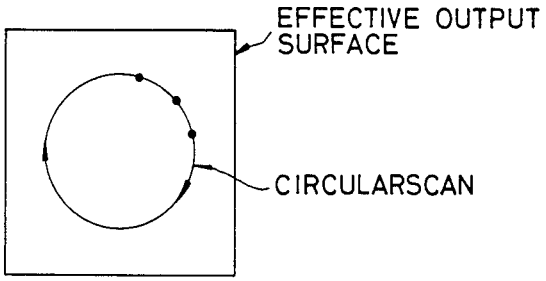
FIG. 11 is an explanatory diagram showing an output image of the circular scan type streak camera.
Figure 12:
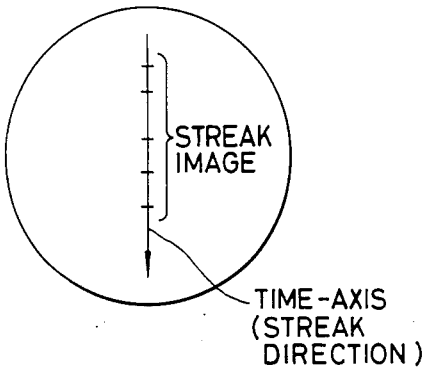
FIG. 12 is an explanatory diagram showing an output image of the linear sweep type streak camera unit.
Figure 13:
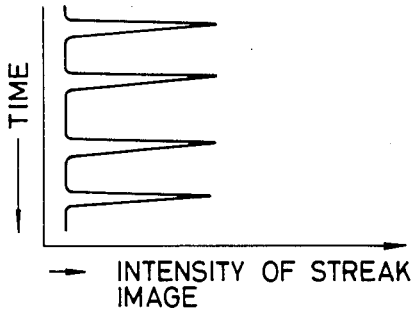
FIG. 13 is a graphical representation indicating the intensity distribution of the output image of the linear sweep type streak camera unit.
Figure 14:
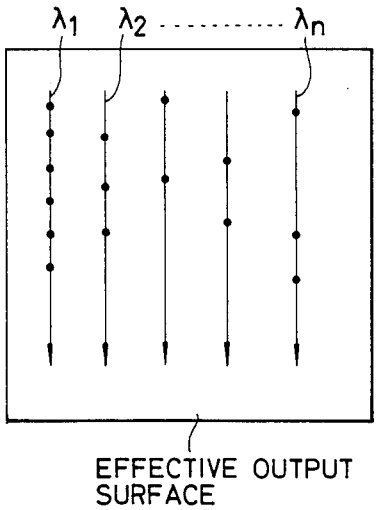
FIG. 14 is an explanatory diagram showing output images provided when spectrometry is performed with the linear sweep type streak camera unit.

FIG. 6 shows another example of the output image of the streak camera unit according to the invention. In the streak camera unit, the DC voltage applied to the second deflection electrodes is gradually changed in synchronization with the sweep voltage. The streak camera unit of FIG. 6 can measure a fluorescence whose period is much longer than the period frequency (FIG. 7). In the measurement, the trigger signal must be a pulse whose frequency is n times the frequency of light emission. Furthermore, a length of the major axis is longer than the effective length of the phosphor screen. Preferably, it is at least 1.5 times the effective length of the phosphor screen.

As has been described in detail, the streak camera unit according to the invention comprises the streak tube including the first deflection electrodes for providing a first deflecting electric field in the same axis direction and the second deflection electrodes for providing a second deflecting electric field in a direction substantially perpendicular to the first deflecting electric field. The DC high voltage generating section for applying operating voltages to the streak tube. The trigger signal generating section generates a trigger signal from the light beam under measurement; and deflecting voltage generating means applies to the first deflection electrodes and the second deflection electrodes in synchronization with the trigger signal the sine wave deflecting voltages whose frequencies are in integer fraction of the frequency of the trigger signal, in order to achieve elliptic sweep. In accordance with the invention, in the composite of the electric fields of the first and second deflection electrodes, the major axis is extended with the direction of the time axis and the sweep going and returning sweeps are separate from each other on the phosphor screen of the streak tube.

Therefore, in the synchroscan streak device, according to the invention, the difficulty that the streak images of different portions of the waveform lie on each other can be prevented; that is, the streak images can be arranged linearly along the time axis direction using a circular scan type streak camera.

Furthermore, according to the invention, the application of the DC voltage to the second deflection electrodes in superposition manner can remove the return sweep image from the effective output surface. Therefore, the effective output surfaces can be effectively utilized, and the difficulty that the background is made bright by the light from the return sweep image can be eliminated.

The invention claimed is:

1. A streak camera device for measuring a repetitive light beam comprising:

a streak tube including photoelectron beam generating means responsive to the light beam, and first deflecting means for providing a first deflecting electric field in the direction of a first axis and second deflecting means for providing a second deflecting electric field in a second direction substantially perpendicular to said first axis and a photoelectron beam detecting means;

DC voltage generating means for supplying operating voltages to said streak tube;

trigger signal generating means for generating a trigger signal responsive to the light beam; and deflecting voltage generating means for applying to said first deflecting means and said second deflecting means in synchronization with said trigger signal, sine wave deflecting voltages whose frequencies are 1/n of the frequency of said trigger signal, where n is a positive integer, to cause an elliptical photoelectron beam sweep having a finite major axis extending in the direction of said first axis and a finite minor axis unequal in length to said major axis so that at least part of said photoelectron beam excites said detecting means.

2. The streak camera as claimed in claim 1, in which said streak tube comprises:

a vaccum container; and a photocathode, a mesh electrode, a focus electrode, an anode having an opening, first and second deflection electrodes for sweeping said photoelectron beam respectively in directions which are perpendicular to each other, and a phosphor screen which are positioned in said vacuum container in the stated order.

3. The streak camera as claimed in claim 1, in which said deflecting voltage generating means includes means for applying sine wave voltages so that the length of said major axis is at least 1.5 times the effective length of said phosphor screen in the direction of said first axis.

4. The streak camera as claimed in claim 1, in which said deflecting voltage generating means comprises: a first deflecting voltage generating means for supplying a deflecting voltage to said first deflecting means and a second deflecting voltage generating means for supplying a deflecting voltage to said second deflecting means.

5. The streak camera as claimed in claim 4, in which said first deflecting voltage generating means comprises: a frequency divider for frequency-dividing an output signal of said trigger signal generating means, a delay circuit responsive to the output of said frequency divider, and sine wave generating means synchronous with the output of said delay circuit, the delay of said delay circuit being variable so that streak images corresponding to different parts of the light beam can be formed successively on said detecting means.

6. The streak camera as claimed in claim 4, in which said second deflecting voltage generating means comprises:

means for generating a sine wave different in phase from the output voltage of said first deflecting voltage generating means in synchronization with the output voltage of said first deflecting voltage generating means; and a horizontal position adjusting circuit for superimposing a variable DC voltage on said sine wave.

7. The streak camera as claimed in claim 6, in which an output voltage of said horizontal position adjusting circuit causes one of the deflections by said first deflecting means to occur outside said phosphor screen.

8. A streak camera as claimed in claim 6, in which an output voltage of said horizontal position adjusting circuit is gradully increased so that, in response to repeated sweeps, streak images are formed at different positions on said detecting means.

9. A streak camera device for measuring a repetitive light beam comprising:

a streak tube including a photocathode responsive to the light beam to produce a photoelectron beam, first deflection electrodes for providing a first deflecting electric field in the direction of a first axis and second deflection electrodes for providing a second deflecting electric field in a direction substantially perpendicular to said first axis, and a photoelectron beam detecting means;

a spectroscope for dispersing the light beam in a direction perpendicular to said first axis as a function of wavelength so as to be applied to said photocathode of said streak tube;

DC voltage generating means for supplying operating voltages to said streak tube;

trigger signal generating means for generating a trigger signal responsive to the light beam; and deflecting voltage generating means for applying to said first deflection electrodes and said second deflection electrodes in synchronization with said trigger signal, sine wave deflecting voltages whose frequencies are 1/n of the frequency of said trigger signal, where n is a positive integer, to cause an elliptical photoelectron beam sweep having a finite major axis extending in the direction of a first axis and a finite minor axis unequal in length to said major axis so that at least part of said photoelectron beam directly excites said detecting means.

* * * * *